US005203321A

United States Patent [19]

Donovan et al.

[11] Patent Number: 5,203,321

[45] Date of Patent: Apr. 20, 1993

[54] PASSIVE ANATOMIC ANKLE-FOOT EXERCISER

[75] Inventors: Thomas L. Donovan, Lompoc; R. J. Allemandi, Sunnyvale, both of Calif.

[73] Assignee: Sutter Corporation, San Diego, Calif.

[21] Appl. No.: 763,636

[22] Filed: Sep. 23, 1991

Related U.S. Application Data

[63] Continuation-in-part of Ser. No. 625,430, Dec. 11, 1990, abandoned.

[51] Int. Cl.[5] ..... A63B 23/08; A63B 23/10

[52] U.S. Cl. ..... 128/25 B; 482/79

[58] Field of Search ..... 128/25 R, 25 B, 26; 482/79, 80

[56] References Cited

U.S. PATENT DOCUMENTS

| | | | |
|---|---|---|---|
| 2,206,902 | 7/1940 | Kost | 128/25 R |
| 4,185,622 | 1/1980 | Swenson | 128/25 B |
| 4,199,137 | 4/1980 | Giguere | 272/96 |
| 4,299,206 | 11/1981 | Hofstein | 128/25 |
| 4,452,447 | 6/1984 | Lepley et al. | 272/96 |
| 4,501,421 | 2/1985 | Kane et al. | 272/96 |
| 4,605,220 | 8/1986 | Troxel | 272/96 |
| 4,635,932 | 1/1987 | Dewees | 272/96 |
| 4,703,928 | 11/1987 | Escher | 482/79 X |
| 4,733,859 | 3/1988 | Kock et al. | 482/79 |
| 4,739,986 | 4/1988 | Kucharik et al. | 272/96 |
| 4,967,737 | 11/1990 | Bassett et al. | 128/25 B |
| 5,035,421 | 7/1991 | Scheller | 128/25 B X |

FOREIGN PATENT DOCUMENTS

| | | | |
|---|---|---|---|
| 425514 | 2/1926 | Fed. Rep. of Germany | 128/25 B |
| 2635457 | 2/1990 | France | 128/25 B |
| 9000383 | 1/1990 | PCT Int'l Appl. | 128/25 B |
| 725666 | 4/1980 | U.S.S.R. | 128/25 B |
| 1378841 | 3/1988 | U.S.S.R. | 128/25 B |
| 1290606 | 9/1972 | United Kingdom | 128/25 B |

*Primary Examiner*—Randall L. Green
*Assistant Examiner*—Mary Beth O. Jones
*Attorney, Agent, or Firm*—Nydegger & Associates

[57] ABSTRACT

A continuous motion passive anatomic ankle-foot exerciser for rehabilitating ankle and foot injuries is provided. The ankle-foot exerciser is constructed to move a patient's foot through a range of motion which may include pure ankle joint motion, pure subtalar joint motion, or a combination of both. The ankle-foot exerciser includes a base, a foot holder, a drive motor for moving the foot holder in an up/down in/out motion, and a foot tilting device for continuously tilting the foot in an inversion/eversion motion. Movement of the foot holder is controlled by an initial positioning of the drive motor and by a control circuit that coordinates the up/down in/out and tilting motions of the foot holder.

20 Claims, 6 Drawing Sheets

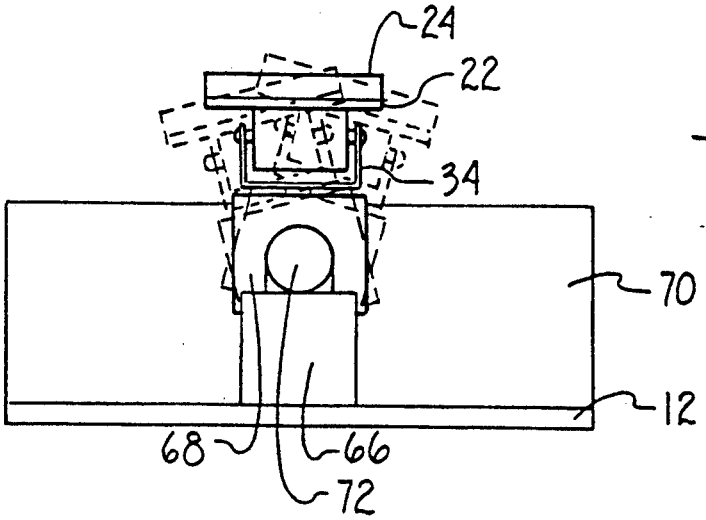
Fig. 9
Fig. 10
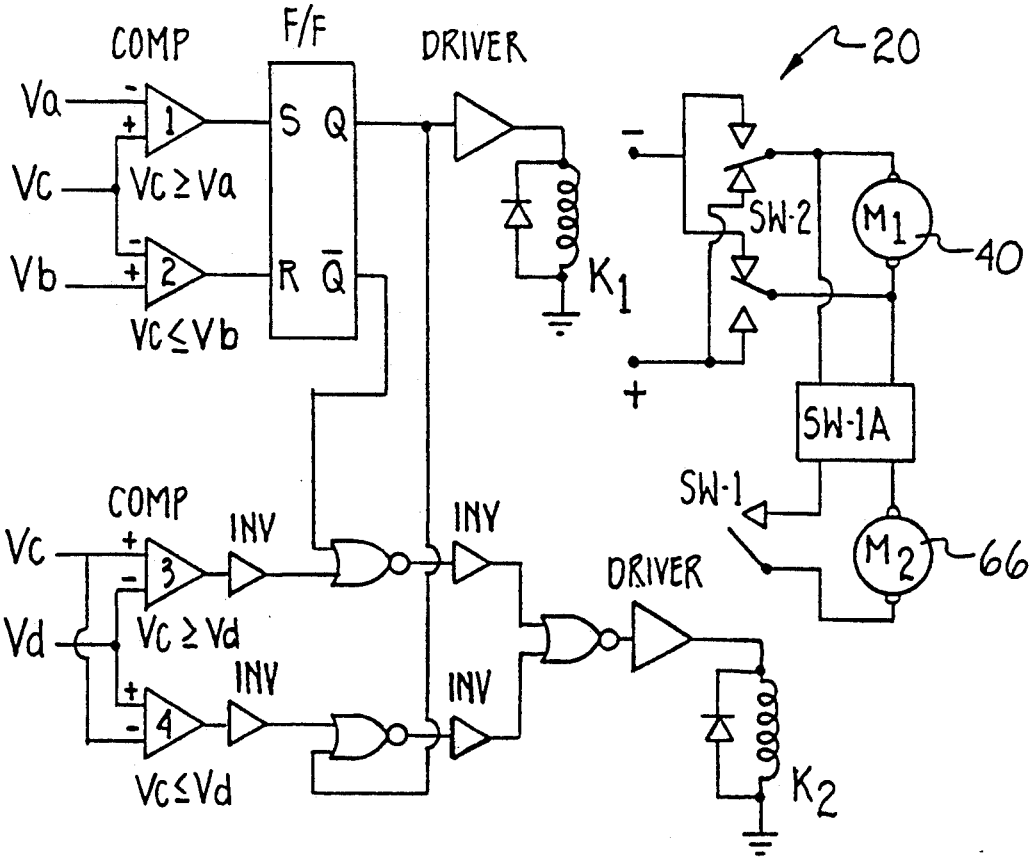

PASSIVE ANATOMIC ANKLE-FOOT EXERCISER

FIELD OF THE INVENTION

This is a continuation-in-part of co-pending Application Ser. No. 07/625,430 filed on Dec. 11, 1990 and now abandoned. This invention relates to exercise and rehabilitation equipment and more particularly to a continuous motion passive anatomic exerciser for rehabilitating ankle-foot injuries.

BACKGROUND OF THE INVENTION

Various anatomical exercise and therapy devices for exercising or conducting specific therapy movements of different muscle groups of a patient are well known in the art. As an example, continuous motion passive exercise machines have now become the standard of care for rehabilitation of joint injuries of injured or surgical patients.

In general, a passive motion exerciser moves a body part such as an arm or foot through a range of motion. This simulates the operation of the muscles and joints associated with the body part. Such passive motion exercisers may be continuous in motion and driven by electric motors or other continuous drive means. U.S. Pat. No. 4,355,633 to Heilbrun discloses such a passive exercise apparatus for exercising the shoulder joint. French Patent No. 2,635,457 to Stef discloses a passive exercise apparatus for the foot and ankle.

A problem with such passive exercise devices, as they are related to ankle and foot rehabilitation, is that in general, the prior art continuous-motion ankle-foot exercise devices do not compensate for the complex anatomical construction of the ankle and foot. Movement of the foot relative to the leg involves the ankle joint as well as the subtalar joint. The axis of the ankle joint and subtalar joint are not coincident to one another. These axes are in fact, located at different angles to the plane and longitudinal axis of the foot. Most prior art passive exercise devices accommodate only the ankle joint.

In FIGS. 1 and 3, the subtalar axis is denoted as S—S. As shown in FIG. 1, the subtalar axis S—S is situated about 45° from the plane of the foot and as shown in FIG. 3 about 84° off the longitudinal axis L—L of the foot. The ankle axis is denoted as A—A in FIGS. 1 and 3. The ankle axis A—A is situated about 13° off the horizontal plane of the foot and as shown in FIG. 3 about 84° off the longitudinal axis L—L of the foot.

As shown in FIG. 1, the ankle joint is formed by the articulation of two bones of the leg, the tibia and fibula, relative to the talus. The talus is the second largest tarsal and the main weight bearing bone of the articulation. The subtalar joint is formed by the articulation of the talus with the largest tarsal the calcaneus.

In FIGS. 2–6, the different motions of the foot are shown. As shown in FIG. 2, movement of the foot from a neutral position and away from the leg is referred to as plantarflexion. Movement of the foot from a neutral position and towards the leg is referred to as dorsiflexion. In general, plantarflexion and dorsiflexion motion involve movement about the ankle joint.

As shown in FIG. 3, the foot may also move from a neutral position towards the center of the body (adduction) or away from the center of the body (abduction). Dorsiflexion has a component of abduction, plantarflexion has a component of adduction.

Additionally, as shown in FIGS. 4–6, the ankle may also be moved from a neutral position (FIG. 5) by turning outward, which is denoted as eversion (FIG. 4), or by turning inward which is denoted as inversion (FIG. 6). In general, eversion and inversion motion of the foot involve movement about the subtalar joint.

As previously stated, most prior art passive exercise apparatus are directed only to ankle joint motion and do not include subtalar joint motion. Moreover, prior art continuous motion passive exercise devices do not allow the different axes of rotation to be isolated (i.e. pure ankle joint motion or pure subtalar joint motion). Consequently, all of the muscles associated with the foot and ankle are not exercised and the different joints cannot be specifically isolated. A total workout of the foot muscles is thus not achieved. Additionally, the muscles of the foot responsible for plantarflexion and dorsiflexion are stronger than the muscles which perform inversion and eversion. Inadequate rehabilitation of the muscles responsible for inversion and eversion may accentuate this imbalance.

The ankle-foot exerciser of the invention, on the other hand, is constructed to passively exercise both the ankle and subtalar joints and allow the muscles associated therewith to follow a natural anatomic range of motion. Additionally, the ankle-foot exerciser of the invention may be adjusted to achieve either pure ankle motion, pure subtalar motion or a combination of both.

SUMMARY OF THE INVENTION

In accordance with the present invention, a novel passive anatomical ankle-foot exerciser is provided. The ankle-foot exerciser is constructed to move a patient's foot through a range of motion which may include pure ankle joint motion, pure subtalar joint motion or a combination of both. The ankle-foot exerciser of the invention thus replicates the complex bio-mechanical axes of the ankle and subtalar joints and allows each axis to be isolated or exercised in complex combined patterns.

The ankle-foot exerciser of the invention, simply stated, comprises: a base, a foot holding means, a drive means for continuously moving the foot holding means to generate dorsiflexion/plantarflexion and adduction-/abduction motions of the foot; foot tilting means for continuously tilting the foot to generate inversion or eversion motions of the foot, and control means for controlling and coordinating operation of the drive means and foot tilting means.

In a preferred embodiment, the drive means may be configured as a worm drive to move the foot holding means up/down and in/out to generate dorsiflexion/-plantarflexion and adduction/abduction motion. The location of the worm drive may be adjusted or located at different positions on the base to achieve a specific range of motion and a specific combination of dorsiflexion/plantarflexion and adduction/abduction motion of the foot. At the same time, the foot tilting means continuously tilts the foot holding means to achieve inversion-/eversion motion of the foot. Different settings of the worm drive may provide isolated or combined motions of the ankle and subtalar joints.

In an alternate embodiment, the drive means is configured to impart a rotational or elliptical motion to the foot holding means. This motion is known in the art as an "Alphabet Soup" motion. In another alternate embodiment the up/down—in/out motion is combined with the "Alphabet Soup" motion.

Other objects, advantages and capabilities of the present invention will become more apparent as the description proceeds.

BRIEF DESCRIPTION OF THE DRAWINGS

FIG. 9 is a partial rear view of FIG. 3 illustrating positions of the foot tilting means of the ankle-foot exerciser of FIG. 7;

FIG. 10 is an electrical schematic of a control means for the ankle-foot exerciser of FIG. 7;

DETAILED DESCRIPTION OF THE INVENTION

Figure 1:
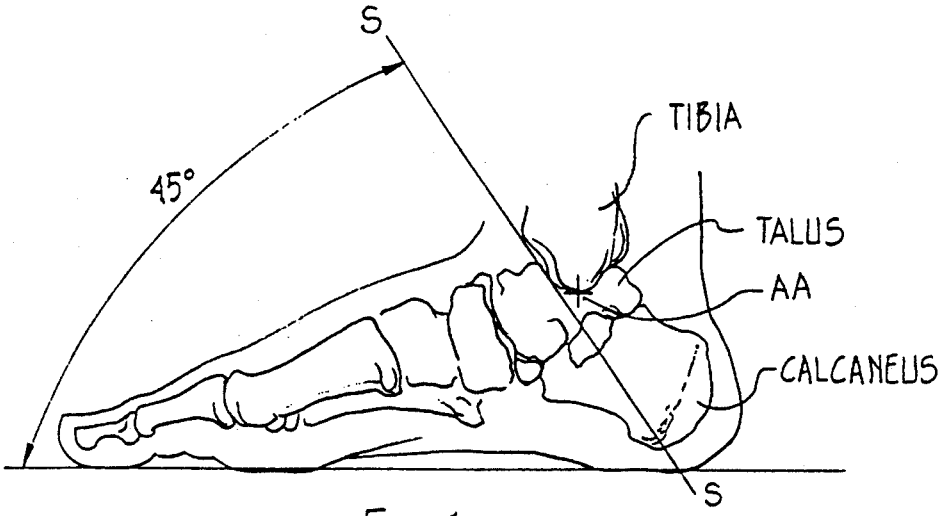
Fig. 1 (PRIOR ART)
FIG. 1 is a diagrammatic representation of the right foot of a patient illustrating the bones of the foot and the axes of the subtalar joint and the ankle joint.
Figure 2:
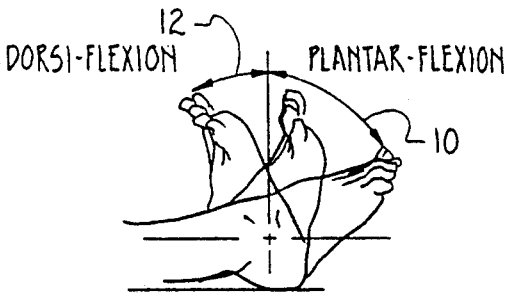
Fig. 2 (PRIOR ART)
FIG. 2 is a side elevation view of a right foot of a patient illustrating dorsiflexion and plantarflexion movement of the foot from a neutral position.
Figure 3:
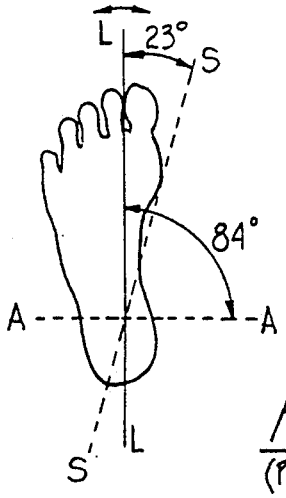
Fig. 3 (PRIOR ART)
FIG. 3 is a top plan view of the left foot of a patient illustrating the axes of the subtalar joint and ankle joint relative to a longitudinal axes of the foot.
Figure 4:
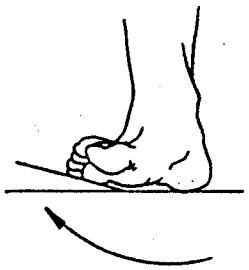
Fig. 4 (PRIOR ART)
FIG. 4 is a front view of the right foot of a patient illustrating eversion of the foot.
Figure 5:
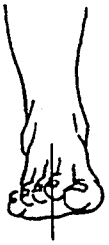
Fig. 5 (PRIOR ART)
FIG. 5 is a front view of the right foot of a patient illustrating a neutral position of the foot.
Figure 6:
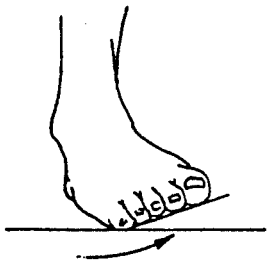
Fig. 6 (PRIOR ART)
FIG. 6 is a front view of the right foot of a patient illustrating inversion of the foot.
Figure 7:
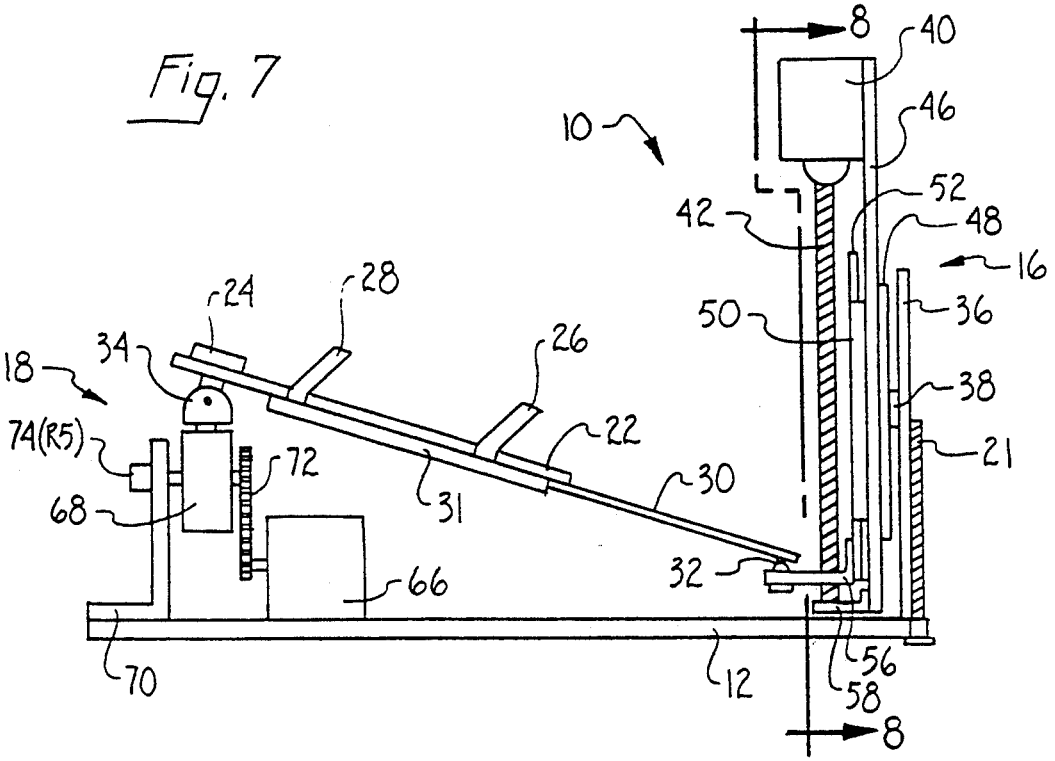
FIG. 7 is a side elevation view of an ankle-foot exerciser constructed in accordance with a preferred embodiment of the invention.

Referring now to FIG. 7, and ankle-foot exerciser constructed in accordance with a preferred embodiment of the invention is shown and generally designated as 10. The ankle-foot exerciser 10 includes: a base 12; a foot holding means 14; a drive means 16 for moving the foot holding means 14 up/down and in/out to generate dorsiflexion/plantarflexion and adduction/abduction of the foot; foot tilting means 18 for continuously tilting the foot from a neutral position to generate inversion and eversion motion of the foot; and control means 20 (FIG. 10) for controlling and coordinating movement of the drive means 16 and foot tilting means 18.

Figure 16:
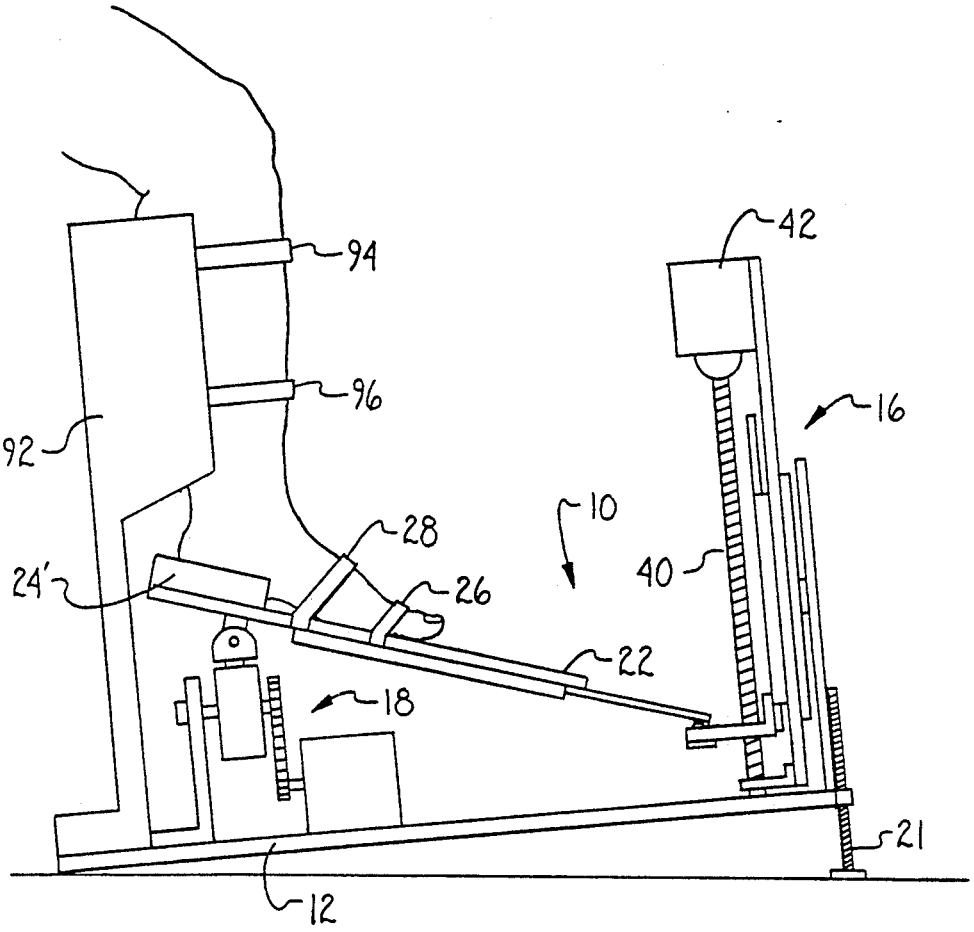
FIG. 16 is a side elevation view showing the ankle-foot exerciser of FIG. 7 in use.

Starting with the base 12, the base 12 is flat and generally rectangular in configuration. The base 12 may be fabricated of a rigid metal or plastic material and is adapted to rest on the floor or ground in a generally horizontal plane. Additionally, the base 12 may include a pair of adjustable legs 21 which can be used as shown in FIG. 16 to position the base 12 at an incline. Alternately, the base 12 may be configured to accommodate an inclining or seated patient. As such, it may include legs which elevate the ankle-foot exerciser 10 to the level of the patient.

The foot holding means 14 will now be explained in detail. The foot holding means 14 includes a slidably mounted foot platform 22, a heel rest 24, and a pair of straps 26, 28 for securing the patient's foot to the foot platform 22. The foot platform 22 of the foot holding means 14 is adapted to be continuously driven by the drive means up/down and in/out to provide dorsiflexion/plantarflexion and adduction/abduction motion of the foot. Additionally, the foot platform 22 is adapted to be continuously tilted by the foot tilting means to move the foot from a neutral position through an inversion-/eversion range of motion.

At the front or toe portion, the foot platform 22 is slidably and pivotally mounted to a drive linkage 30. The drive linkage slides within a guide track 31. The drive linkage 30 is mounted to the drive means 16 using a universal joint 32. At the rear or heel portion, the foot platform 22 is hingedly or pivotably attached by a hinge 34 to the foot tilting means 18.

The foot straps 26, 28 are adapted to strap a foot of the patient to the foot platform 22. The foot straps 26, 28 may be provided with Velcro TM hook and loop fasteners for attachment to the foot platform 22.

In use, the patient's heel rests on the heel platform 24. The heel platform 24 may be formed as a flat plate as shown in FIG. 7 or alternately as shown in FIG. 16 as a cup shaped member 24' for cradling the patient's heel. The foot straps 26, 28 hold the patient's foot flat against the foot platform 22. Additionally as also shown in FIG. 16, a leg holder 92 is attached to the base 12 for holding the patient's leg stationary during use of the ankle-foot exerciser. For simplicity, the leg holder 92 is not illustrated in FIG. 7.

Figure 8:
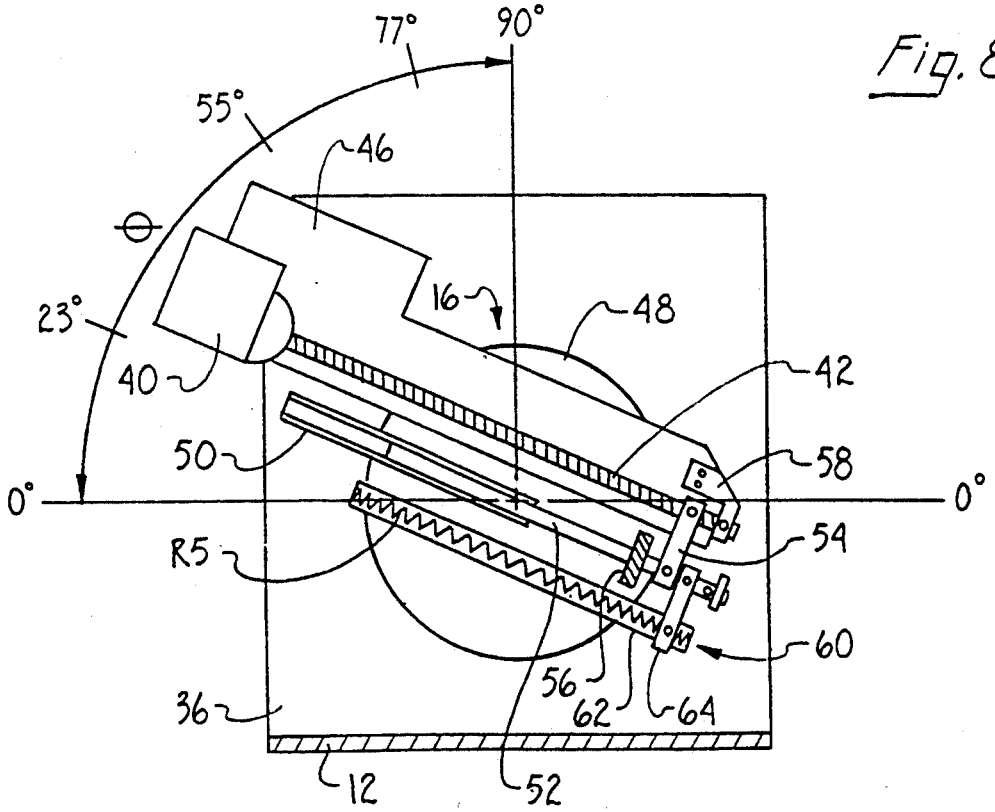
FIG. 8 is a cross-sectional view taken along line 8—8 of FIG. 7.

The drive means 16 will now be explained in detail. Drive means 16 is mounted on a flat generally rectangular shaped support plate 36. Support plate 36 is fixedly attached to the base 12 generally perpendicular to the plane of the base 12. The whole of the drive means 16 is pivotally mounted to the support plate 36 on a pivot mount 38. This permits the entire drive means 16 to be manually located and fixed at an angle $\theta$ of from 0° to 90° as shown in FIG. 8. Adjustable set screws or other fasteners (not shown) may be used to secure the position of the drive means 16 at a desired angle $\theta$.

As will hereinafter be more fully explained, the angle $\theta$ of the drive means 16 will determine dorsiflexion/-plantarflexion motion relative to abduction/adduction motion of the patient's foot. The drive means 16 may be positioned for either the left or right foot of the patient. Additionally, fixed settings are provided at 0°, 23°, 55°, 77°, and 90° which correspond to the following anatomical motions of the ankle joint and subtalar joint:

TABLE 1

| Setting for $\theta$ | Anatomical motion produced |
|---|---|
| 0° | Pure abduction/adduction |
| 23° | Pure subtalar motion |
| 55° | Equal subtalar and ankle motion |
| 77° | Pure ankle motion |

TABLE 1-continued

| Setting for $\theta$ | Anatomical motion produced |
|---|---|
| 90° | Pure dorsiflexion/plantarflexion |

These angles are based upon the biomechanics for the ankle and subtalar joints previously discussed.

The drive means 16 includes a worm drive 42, a worm drive motor 40 (M1 FIG. 10), and the universal joint 32 which attaches to the slidably mounted drive linkage 30. The worm drive motor 42 is mounted on a worm drive holder bracket 46 which is attached to a pivot mounting plate 48 and to the pivot mount 38. The whole of the drive means can thus be rotated and positioned at an angle $\theta$ as previously explained.

Additionally the drive means 16 includes a slide assembly. The slide assembly drives the drive linkage 30 for the foot platform 22. Additionally, the slide assembly is a mechanical component of the control means 20 of the ankle-foot exerciser 10 and functions as a means for detecting the movement and location of the drive auger 42 and for positioning the foot tilting means 18 responsive to the operation of the drive means 16. The slide assembly comprises a stationary slide mount 50 and a slide member 52 (FIG. 8). Stationary slide mount 50 is attached to first mounting plate 48. The slide member 52 is coupled to the worm drive 40 through a connector 54 (FIG. 8). Rotation of the worm drive 42 by worm drive motor 40 moves the connector 54 along the worm drive 40 and thus moves the slide member 52. With this arrangement, movement of the worm drive 42 and the location of the pivot mounting bracket 56 on the worm drive 42 can be determined and correlated to movement and positioning of the foot platform 22.

The universal joint 32 is also attached to the slide member 52 on a pivot mounting bracket 56. The universal joint 32 is also attached to slide member 30 of the foot holding means 14. A worm drive mounting bracket 58 is fixedly attached to the worm drive holder bracket 46 as support for the worm drive 42. Rotation of the drive auger 44 thus drives the slide member 30 and the foot holding means 14. Depending on the angle $\theta$ (which is manually set by rotation of the drive means 16 on the pivot mount 38), the foot holding means 14 may be moved through a variable range of motion. The range of motion may be correlated to the ankle joint or subtalar joint as illustrated in Table 1.

In addition to driving the foot holding means 14, rotation of the worm drive 42 drives a slide translation assembly 60 which controls and coordinates the movement of the foot tilting means 18. Operation of the slide translation assembly will be more fully hereinafter explained with reference to FIGS. 10, 11, 12, and 13. Mechanically, the slide translation assembly 60 includes a sensor 62 which is fixedly mounted to pivot mounting plate 48 and a slide connector 64 that is coupled to movement of the slide member 52 of the drive means 16.

Referring again to FIG. 7, the foot tilting means 18 will be explained in detail. The foot tilting means 18 is continuously driven to tilt the patient's foot from a neutral position in response to signals received from the slide translation assembly 60. Rotation of the drive auger 42 thus produces movement of the foot holding means 14 that is generally up and down and in and out and a corresponding controlled movement of the foot tilting means 18 for moving the foot in inversion/eversion.

The foot tilting means 18 includes a tilt drive motor 66 and a tilt drive platform 68. The tilt drive platform 68 is pivotally mounted on a tilt support bracket 70 that is fixedly attached to the base 12.

The tilt drive motor 66 is drivably coupled by a chain or belt drive 72 to the tilt drive motor 66. As shown in FIG. 9 this allows the tilt drive platform 68 to be continuously tilted from a neutral (straight up and down) position through an eversion or inversion range of motion and back again. A range of motion of the tilt drive platform 68 may be set with the control means. The tilt drive platform 68 is continuously driven through this range of motion by the tilt drive motor 66 in response to signals generated by the control means 20 (FIG. 10). Movement of the tilt drive platform 68 is transferred by hinge 34 to the foot platform 22 of the foot holding means 14.

The foot platform 22 is thus continuously tilted by the foot tilting means 18 while being driven up and out or down and in by the drive means 16. The slide mounting of the foot platform 22 to drive linkage 30 as well as the universal pivoting of universal joint 32, and hinge 34 support the foot platform 22 for this complex range of motion.

Referring now to FIGS. 10, 11, 12, and 13 the control means 20 for controlling movement of the foot platform 22 is shown. Simply stated, the control means 20 controls the movement of the foot platform 22 (up and out, down and in) for speed and distance traveled and the foot tilting means 18 (i.e. inversion/eversion) for speed and degrees of movement.

Figure 11:
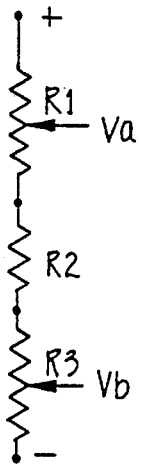
FIG. 11 is an electrical schematic of a portion of the control means of the ankle-foot exerciser of FIG. 7.

With reference to FIG. 11, R1 comprises a potentiometer that sets the limit of the up and out movement of the foot platform 22 to produce Va (FIG. 10). R3 comprises a potentiometer that sets the limit on the down and in movement of the foot platform 22 to produce Vb (FIG. 10). R2 comprises a small resistor that separates the two settings Va and Vb.

Figure 12:
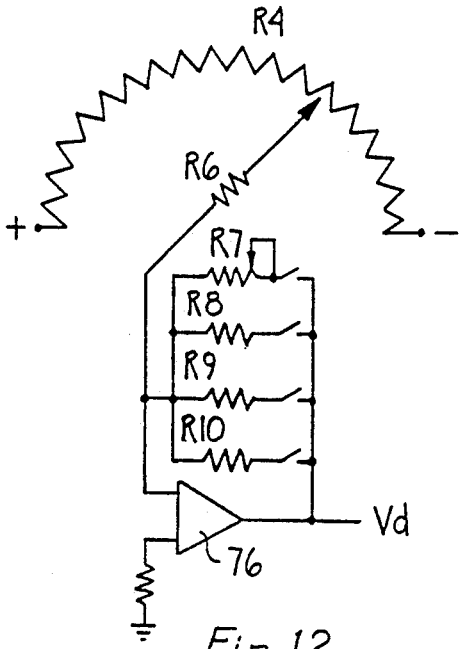
FIG. 12 is an electrical schematic of a portion of the control means of the ankle-foot exerciser of FIG. 7.
Figure 13:
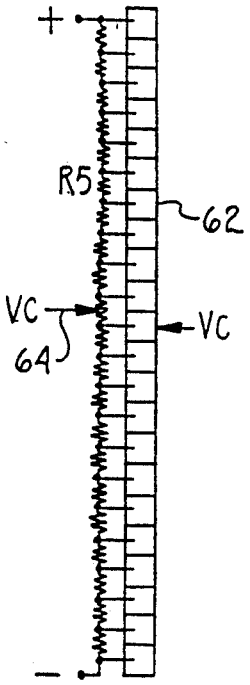
FIG. 13 is an electrical schematic of a sensor of the control means.

R4 (FIG. 12) comprises a potentiometer that is coupled to a control shaft 74 (FIG. 7) of the foot tilting means 18 to detect degrees of movement of the tilt drive platform 68. This resistor R4 may be coupled through a circuit of resistors R7-R10 as shown in FIG. 12 and an invertor 76 to set the limit on the angular movement of the foot drive platform 68 to produce Vd.

R5 (FIG. 13) is physically mounted in sensor 62 (FIG. 8) of the slide translation assembly 60. As illustrated schematically in FIG. 13, R5 is preferably a long potentiometer with a slide contact coupled to slide connector 64 (FIG. 8) and to slide member 52. Alternately, R5 may be comprised of a plurality of small resistors of equal values connected to isolated metal strips such that a moving contact will detect equal changing voltages on each isolated strip (Vc).

As shown in FIG. 10, Comparator 1, compares voltage setting (Va) (R1) to voltage detected on R5 (Vc). When $(Vc) \geqq (Va)$ a set/reset flip flop is set pulling in relay K1, which reverses motors M1 and M2. (M1 is the worm drive motor 40, M2 is the tilt drive motor 66).

Comparator 3, compares (Vc) and (Vd). When $(Vc) \geqq (Vd)$ the flip flop is set and driver 2 will pull in relay K2 which causes M2 to rotate the foot platform 22 until $(Vc) \leqq (Vd)$ and then it will shut off.

Comparator 4, compares (Vc) and (Vd) in the same manner as comparator 3; however, it will only operate drive 2 when $(Vc) \leqq (Vd)$ and the flip flop is reset. This will allow the foot platform 22 to rotate in the opposite direction because the flip flop will have reversed the motors M1 and M2.

Potentiometer R4 (FIG. 12) is directly connected to the tilt drive platform 68 of the foot tilting means 18 and is set such that 0 volts will be detected at (Vd) with zero tilt or a neutral position of the foot. Maximum voltage with a maximum tilt will be detected in one direction and minimum voltage with maximum tilt in the other direction (FIG. 12). (Vd) will be amplified such that (Vd) will be at its maximum/minimum (±volts) for ±20 degrees. In turn, additional amplification will be required as will be apparent to one skilled in the art, for smaller degrees of tilt.

As an example, if the desired inversion/eversion is ±15 degrees then the amplification will be increased by a factor of approximately 1.33. For ±5 degrees it would be increased by a factor of four. The override switch will connect a variable resistor to set the amplification to the desired level for the selected inversion/eversion modulation.

Figure 17:
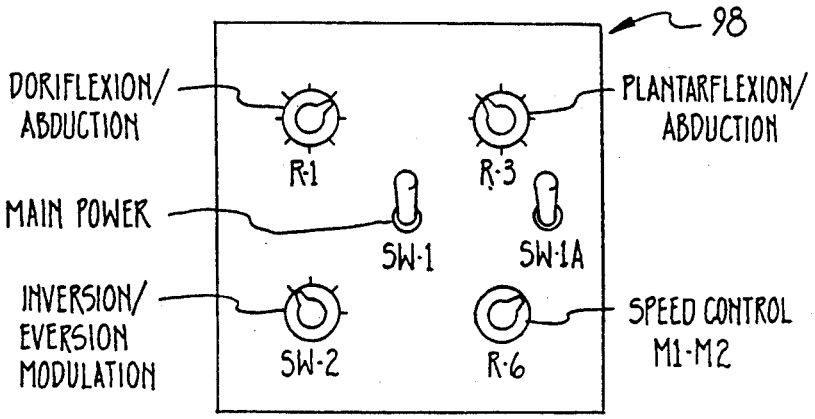
FIG. 17 is a front elevation view showing a control panel for the ankle-foot exerciser of FIG. 7.

A control panel 98 for manually setting the range of motions of the foot platform and for manually setting components R-1, R-3, SW-1, SW-1A, SW-2, and R-6 is shown in FIG. 17. The control means 20 thus provides for setting the range of motions of the foot platform and for coordinating movement of the drive means 16 and drive auger 42 with the foot tilting means 18. In the illustrative embodiment, the control means 20 includes means for detecting the movement and location of the drive auger 42 with a means for generating a corresponding movement of the foot tilting means 18. Alternately, other control arrangements may be utilized for coordinating movement of the foot tilting means 18 and drive means 16. In general, any control arrangement in which the range and limits of motions is controlled as well as the coordination of the separate motions will be suitable.

Figure 14:
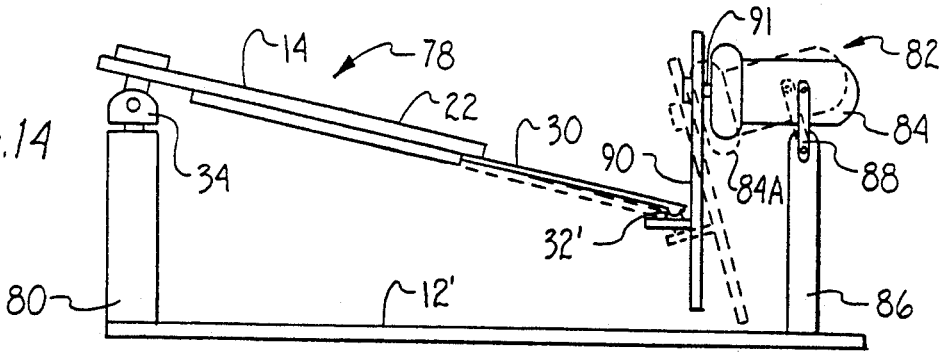
FIG. 14 is a side elevation view of an alternate embodiment ankle-foot exerciser having a drive means for generating a circular or "Alphabet Soup" motion.

Referring now to FIG. 14 an alternate embodiment ankle-foot exerciser is shown and generally designated as 78. In the alternate embodiment, ankle-foot exerciser 78, the foot platform 22 of the foot holding means 14 is pivotally mounted at the heel portion to a support 80 which is fixedly attached to the base 12'. The front or toe portion of the foot platform 22 is connected by a universal joint 32' to a circular drive means 82. The circular drive means 82 may include a circular drive motor 84 mounted on a pivot bracket 88 to a stationary support 86. An output shaft 91 of the circular drive motor 84 is coupled to a circular drive linkage 90 to the universal pivot 32 and drive linkage 30.

Figure 14A:
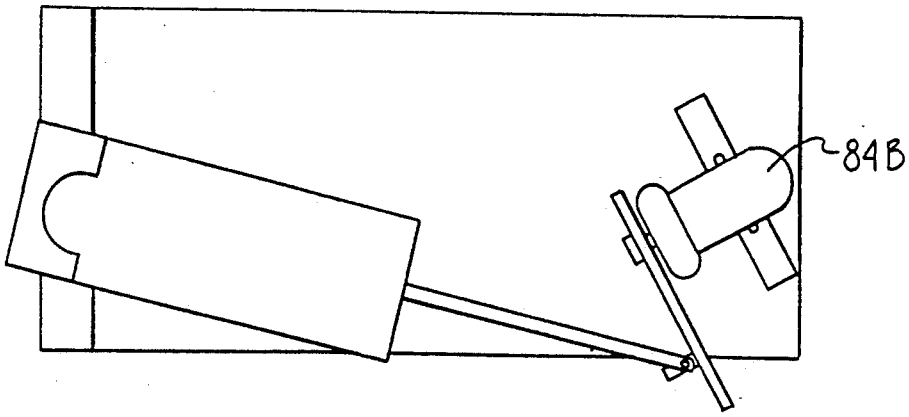
FIG. 14A is a plan view of FIG. 14 showing the drive means in a different position for generating vertical ellipses.

As is apparent this circular drive embodiment 78 produces a generally circular or conical motion of the patient's foot. This is a motion which is known in the art as an "Alphabet Soup" motion. The range of motion of the circles can be adjusted by the position of universal joint 32' on circular drive linkage 90. Additionally, the circular drive motor 84 may be oriented as shown in fathom to produce horizontal ellipses (84A) or as shown in FIG. 14A to produce vertical ellipses (84B).

Figure 15:
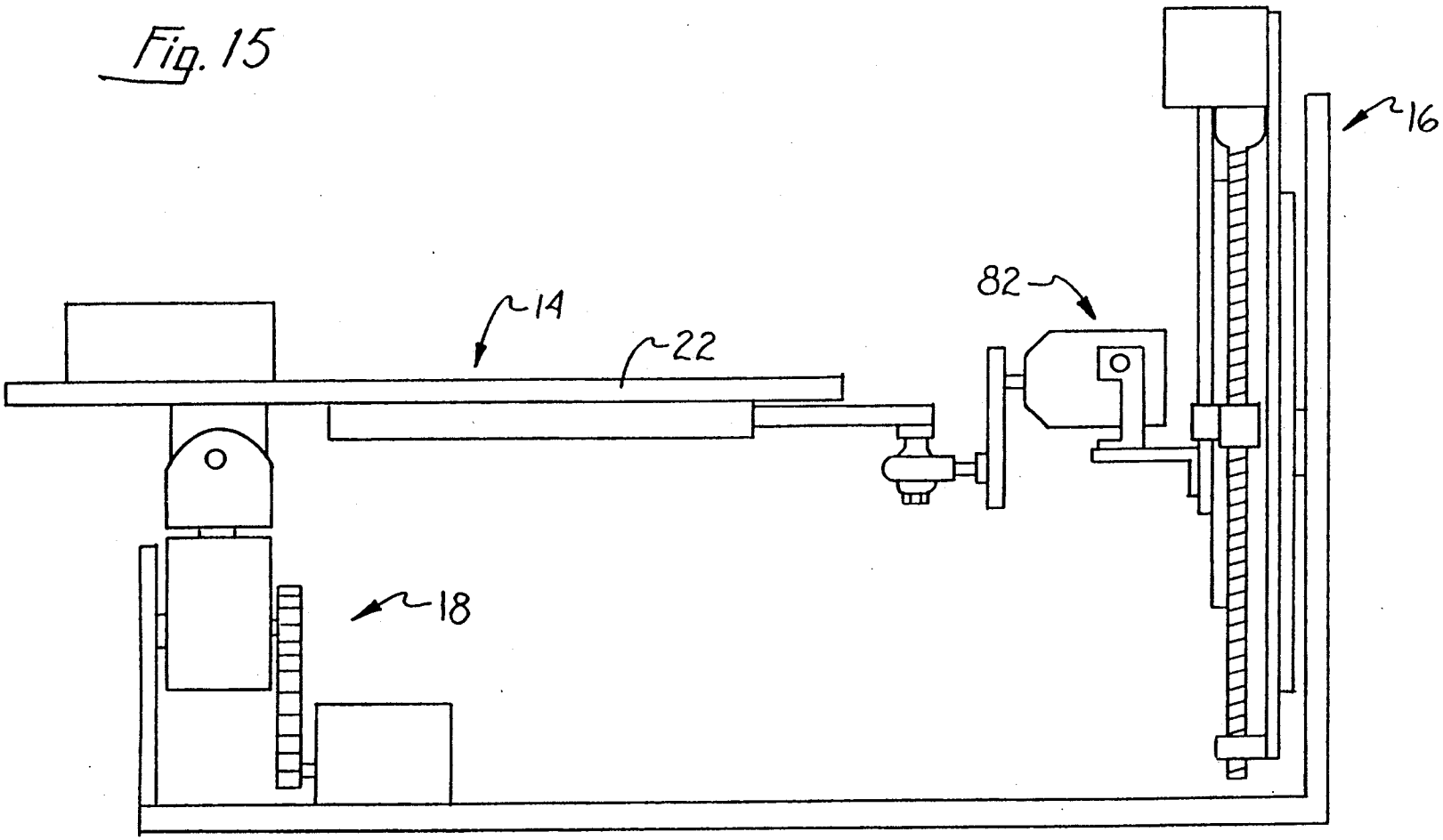
FIG. 15 is a side elevation view of another alternate embodiment ankle-foot exerciser having a drive means Which combines the drive means of the embodiments shown in FIG. 7 and FIG. 14.

With reference to FIG. 15, a circular drive 82 as illustrated in FIG. 14 may be combined with the generally up/down out/in drive 16, illustrated in FIG. 7, to combine both an "Alphabet Soup" motion of a circular drive 82 with the previously described plantar/flexion, abduction/adduction, inversion/eversion motion.

Referring now to FIG. 16 the basic embodiment ankle-foot exerciser 10 shown in FIG. 7 is shown in use. A patient's foot is placed on the foot platform 22 and strapped with straps 26, 28 to the foot platform. Foot platform 22 includes a cup shaped heel support 24' as previously described. Additionally, a leg holder 92 is attached to the base 12 for holding the patient's leg in a stationary position utilizing leg straps 94, 96. The leg holder 92 maintains a desired position of the tibia and fibula relative to the foot and ankle joint. An angle $\theta$ is the drive means 16 to achieve a desired motion of the ankle joint and subtalar joint of the foot (i.e. pure dorsiflexion/plantarflexion, pure abduction/adduction, or a combination of both). Rotation of the worm drive 40 by worm drive motor 42 moves the foot platform 22 up and down for dorsiflexion/plantarflexion. For introducing a component of abduction/adduction the drive means 16 may be rotated to an angle (i.e. 23°) as previously described.

At the same time the toe portion of the foot platform 22 is driven up/down in/out the entire foot platform 22 is tilted for producing an inversion/eversion motion of the foot by the foot tilting means 18. The tilting is continuous through a range of motion from a neutral position to maximum inversion or eversion as shown in FIG. 9. This range of motion may be selected using the control means 20 (FIGS. 10–13) as previously described and corresponds to the range of motion of the drive means 16. The up/down in/out motion of the drive means 16 is selected and coordinated by the control means 20 (FIGS. 10–13) with the tilting motion of the foot tilting means 18 as previously described.

The drive means 16 and foot tilting means 18 may be adjusted for use with either a patient's right or left foot. Additionally, the range of motion of the drive means 16 and foot tilting means 18 may be adjusted with the control means 20 to suit the patient. Finally, the angle of the base 12 may be adjusted as shown to vary the location of the foot relative to the leg.

Thus the invention provides a passive motion ankle-foot exerciser in which both the ankle joint and subtalar joint can be exercised. Moreover, the ankle-foot exerciser may be adjusted to isolate either the ankle or subtalar joint. In an alternate embodiment an "Alphabet Soup" motion is provided or a combination of both motions may be provided.

While preferred embodiments of the invention have been disclosed, various modes of varying out the principles disclosed herein are contemplated as being within the scope of the following claims. Therefore, it is understood that the scope of the invention is not to be limited except as otherwise set forth in the claims.

We claim:

1. An ankle-foot exerciser comprising:

a base;

foot holding means mounted to the base for holding a patient's foot and including a toe portion and a heel portion;

adjustable drive means adjustable in angular orientation with respect to the base and pivotally and slidably attached to the toe portion of the foot holding means for continuously driving the foot holding means alternately up and down and alternately out and in to alternately generate dorsiflexion and plantarflexion and to alternately generate abduction and adduction motion of the foot;

foot tilting means pivotally attached to the heel portion of the foot holding means for tilting the foot holding means to alternately generate eversion and inversion motion of the foot; and control means for controlling and coordinating the drive means and the foot tilting means.

2. The ankle-foot exerciser as claimed in claim 1 and wherein:

the drive means can be adjusted to generate a range of motion of a patient's foot from pure dorsiflexion and plantarflexion motion to pure abduction and adduction motion or a combination of both.

3. The ankle-foot exerciser as claimed in claim 2 and wherein:

the drive means includes a worm drive attached to the foot holding means and driven by a worm drive motor.

4. The ankle-foot exerciser as claimed in claim 3 and wherein the foot holding means includes a foot platform having a toe portion slidably and pivotally attached to the worm drive and a heel portion pivotably attached to the foot tilting means.

5. The ankle-foot exerciser as claimed in claim 4 and wherein:

the foot tilting means includes a tilt drive motor operated by signals responsive to movement of the worm drive.

6. The ankle-foot exerciser as claimed in claim 5 and wherein:

the drive means and foot tilting means continuously move the foot through a range of plantarflexion and dorsiflexion, abduction and adduction, and eversion and inversion motion as determined by initial settings of the drive means and foot tilting means.

7. The ankle-foot exerciser as claimed in claim 6 and wherein:

the control means includes a slide mechanically coupled to the drive auger for movement therewith and electrically coupled to the tilt drive means for generating signal thereto.

8. The ankle-foot exerciser as claimed in claim 1 and further comprising:

a second drive means pivotally attached to the toe portion of the foot holding means for moving a toe portion of the foot holding means in a generally circular or elliptical pattern.

9. An ankle-foot exerciser comprising:

a base;

foot holding means mounted to the base and including a foot platform for a patient's foot with a heel portion and a toe portion;

drive means including a drive motor and a drive auger adjustably mounted on the base and pivotally and slidably attached to the toe portion of the foot platform for moving the foot platform alternately in an up and down or in and out motion in order to alternately generate plantarflexion and dorsiflexion or to alternately generate abduction and adduction of the patient's foot with the drive means adjustable to generate pure plantarflexion and dorsiflexion motion or pure abduction and adduction motion or a combination of both;

foot tilting means pivotally attached to the heel portion of the foot platform for continuously tilting the foot platform through a range of motion responsive to the motion of the drive means to generate inversion and eversion of the patient's foot; and control means for controlling and coordinating the drive means and the foot tilting means.

10. The ankle-foot exerciser as claimed in claim 9 and wherein:

the foot tilting means includes a tilt drive motor drivably coupled to the foot platform.

11. The ankle-foot exerciser as claimed in claim 10 and wherein the control means include:

means for detecting a movement of the drive auger;

means for detecting an angular location of the foot tilting means; and means for generating movement of the foot tilting means responsive to movement of the driver auger and angular location of the foot tilting means.

12. The ankle-foot exerciser as claimed in claim 11 and wherein:

the means for detecting movement of the drive auger includes a slide member coupled to the drive auger; and a sensor mechanically coupled to the slide member and electrically coupled to the tilt drive motor.

13. The ankle-foot exerciser as claimed in claim 12 and wherein:

the base includes adjustable legs for locating the base at an angle to a horizontal position.

14. The ankle-foot exerciser as claimed in claim 13 and wherein:

the foot platform includes a cup shaped heel support.

15. The ankle-foot exerciser as claimed in claim 9 and wherein:

a second drive means is coupled to the first drive means and to the toe portion of the foot platform for generating generally circular or elliptical motion of the toe portion of the foot platform.

16. A passive continuous motion ankle-foot exerciser comprising:

a base:

a foot holding means including a foot platform having a heel portion and a toe portion and mounting straps for securing a patient's foot thereto;

a drive means including a worm gear pivotally and slidably mounted to the toe portion of the foot platform for moving the foot platform in an up and down or in an in and out motion and manually adjustable through an angle $\theta$ for generating a range of motion of the patient's foot from pure plantarflexion and dorsiflexion to pure abduction and adduction or a combination thereof;

a foot tilting means pivotally attached to the foot platform for tilting the foot platform to move the patient's foot in inversion or eversion with the motion of the foot tilting means coordinated with the motion of the worm gear; and control means for controlling a range of motion of the foot platform and foot tilting means and for controlling movement of the foot tilting means responsive to rotation of the worm gear.

17. The ankle-foot exerciser as claimed in claim 16 and wherein:

the drive auger can be located at set positions corresponding to $\theta$ angles of 0°, 23°, 55°, 77°, and 90°.

18. The ankle-foot exerciser as claimed in claim 16 and wherein:

the control means includes a slide mechanically coupled to movement of the drive auger and electrically coupled to a tilt drive motor for the foot tilting means.

19. The ankle-foot exerciser as claimed in claim 18 and further comprising:

a leg holder attached to the base for holding a patient's leg in a stationary position.

20. An ankle-foot exerciser comprising:

a base;

a foot holding means mounted to the base and including a foot platform with the toe portion and a heel portion with the heel portion pivotally attached to the base;

a drive means pivotally and slidably coupled to the toe portion of the foot platform for moving the toe portion in a generally circular or elliptical pattern; and a second drive means pivotally attached to the first drive means for moving the toe portion of the foot platform up or down and in or out.

* * * * *